US010665401B2

(12) United States Patent
Wu et al.

(10) Patent No.: US 10,665,401 B2
(45) Date of Patent: May 26, 2020

(54) ELECTRIC SWITCH

(71) Applicant: ABB Oy, Helsinki (FI)

(72) Inventors: Yi'er Wu, Guangdong (CN); Jiancheng Ren, Guangdong (CN); Aki Suutarinen, Vaasa (FI); Janne Rosenberg, Vaasa (FI)

(73) Assignee: ABB Schweiz AG, Baden (CH)

( * ) Notice: Subject to any disclaimer, the term of this patent is extended or adjusted under 35 U.S.C. 154(b) by 47 days.

(21) Appl. No.: 15/566,621

(22) PCT Filed: Apr. 13, 2015

(86) PCT No.: PCT/CN2015/076429

§ 371 (c)(1),
(2) Date: Oct. 13, 2017

(87) PCT Pub. No.: WO2016/165054

PCT Pub. Date: Oct. 20, 2016

(65) Prior Publication Data

US 2018/0082807 A1 Mar. 22, 2018

(51) Int. Cl.
*H01H 19/14* (2006.01)
*H01H 19/24* (2006.01)
(Continued)

(52) U.S. Cl.
CPC ..... *H01H 19/14* (2013.01); *H01H 3/38* (2013.01); *H01H 3/40* (2013.01); *H01H 3/46* (2013.01);
(Continued)

(58) Field of Classification Search
CPC ..... H01H 19/14; H01H 3/46; H01H 3/38; H01H 3/40; H01H 19/24; H01H 5/06; H01H 19/64
(Continued)

(56) References Cited

U.S. PATENT DOCUMENTS 8,357,868 B2 * 1/2013 Soininen ..... H01H 71/128 200/336
2011/0308928 A1 * 12/2011 Eisner ..... H01H 9/342 200/5 A

FOREIGN PATENT DOCUMENTS

CN 1910715 A 2/2007
CN 1914703 A 2/2007
(Continued)

OTHER PUBLICATIONS

International Search Report, PCT/CN2015/076429, ABB Oy, dated Dec. 21, 2015, 6 pages.
(Continued)

*Primary Examiner* — Edwin A. Leon
*Assistant Examiner* — Lheiren Mae A Caroc
(74) *Attorney, Agent, or Firm* — Taft Stettinius & Hollister LLP; J. Bruce Schelkopf

(57) ABSTRACT

An electric switch comprising a mechanism module and a contact module, the contact module comprising a base element, a cover element, fixed contacts and a rotary roll for receiving moving contacts, the mechanism module comprising a base element, a cover element, a front pipeshaft for controlling the switch from front, an inner pipeshaft for controlling the switch from side end, the pipeshafts being engaged to each other by teeth to form a gear for transferring a moment from the front pipeshaft to the inner pipeshaft, a lever for transferring a moment to the roll, the lever arranged to receive the inner pipeshaft, the inner pipeshaft and the lever being rotatable engaged with each other, and main springs for giving a rotational moment for the lever and being connected of first ends to the base element and the mains springs being connected to the lever of their second ends.

13 Claims, 8 Drawing Sheets

(51) Int. Cl.

| | |
|---|---|
| ***H01H 3/40*** | (2006.01) |
| ***H01H 3/38*** | (2006.01) |
| ***H01H 3/46*** | (2006.01) |
| *H01H 19/64* | (2006.01) |
| *H01H 5/06* | (2006.01) |
| *H01H 71/56* | (2006.01) |

(52) U.S. Cl.
CPC ..... *H01H 19/24* (2013.01); *H01H 5/06* (2013.01); *H01H 19/64* (2013.01); *H01H 2071/565* (2013.01)

(58) Field of Classification Search
USPC ..... 200/244, 336, 564
See application file for complete search history.

(56) References Cited

FOREIGN PATENT DOCUMENTS

| | | | |
|---|---|---|---|
| CN | 101556870 | A | 10/2009 |
| CN | 102067260 | A | 5/2011 |
| CN | 102468077 | A | 5/2012 |
| CN | 103366979 | A | 10/2013 |
| EP | 0823720 | A1 | 2/1998 |
| EP | 2843676 | A1 | 3/2015 |
| SU | 144885 | A1 | 11/1961 |
| WO | 2005/076302 | A1 | 8/2005 |

OTHER PUBLICATIONS

Written Opinion, PCT/CN2015/078429, ABB Oy, dated Dec. 28, 2015, 4 pages.
Translated Summary of First Chinese Office Action dated Sep. 18, 2018; China Patent Application No. 201580078796.5; 1 pg.
European Search Report dated Nov. 13, 2018; European Patent Application No. 15888759.6; Applicant: ABB Oy 7 pgs.
Russian Patent Office, International Search Report dated Jun. 28, 2018, 2 pgs.

* cited by examiner

ELECTRIC SWITCH

FIELD

The present invention relates to an electric current switching apparatus, like switches or load switch-disconnectors.

BACKGROUND

Many issues affect designing of an electric current switching apparatus. The design goals include, for instance, less complex structure, ease of assembly of the switch, possibility to assemble various switch types, security of use the switch, fast connecting and disconnecting of the contacts and efficient quenching of an arc when the switch was opened.

SUMMARY

An object of the present invention is to provide an improved electric current switch. The object is achieved with an invention, which is defined in the independent claim. Some embodiments are disclosed in the dependent claims.

DRAWINGS

In the following, the invention will be described in greater detail by means of some embodiments with reference to the accompanying drawings, in which FIG. 1 shows an embodiment of a switch, comprising a mechanism module and a a contact module, connected to each other;

DETAILED DESCRIPTION

An electric switch may comprise a mechanism module and a contact module with plurality of poles to build a multi-pole switch. Modules may comprise an insulating housing, which accommodates the mechanical or electrical components of the switch. Each module housing may be made of plastic, for instance. The housing modules may be substantially rectangular shaped.

Figure 1:
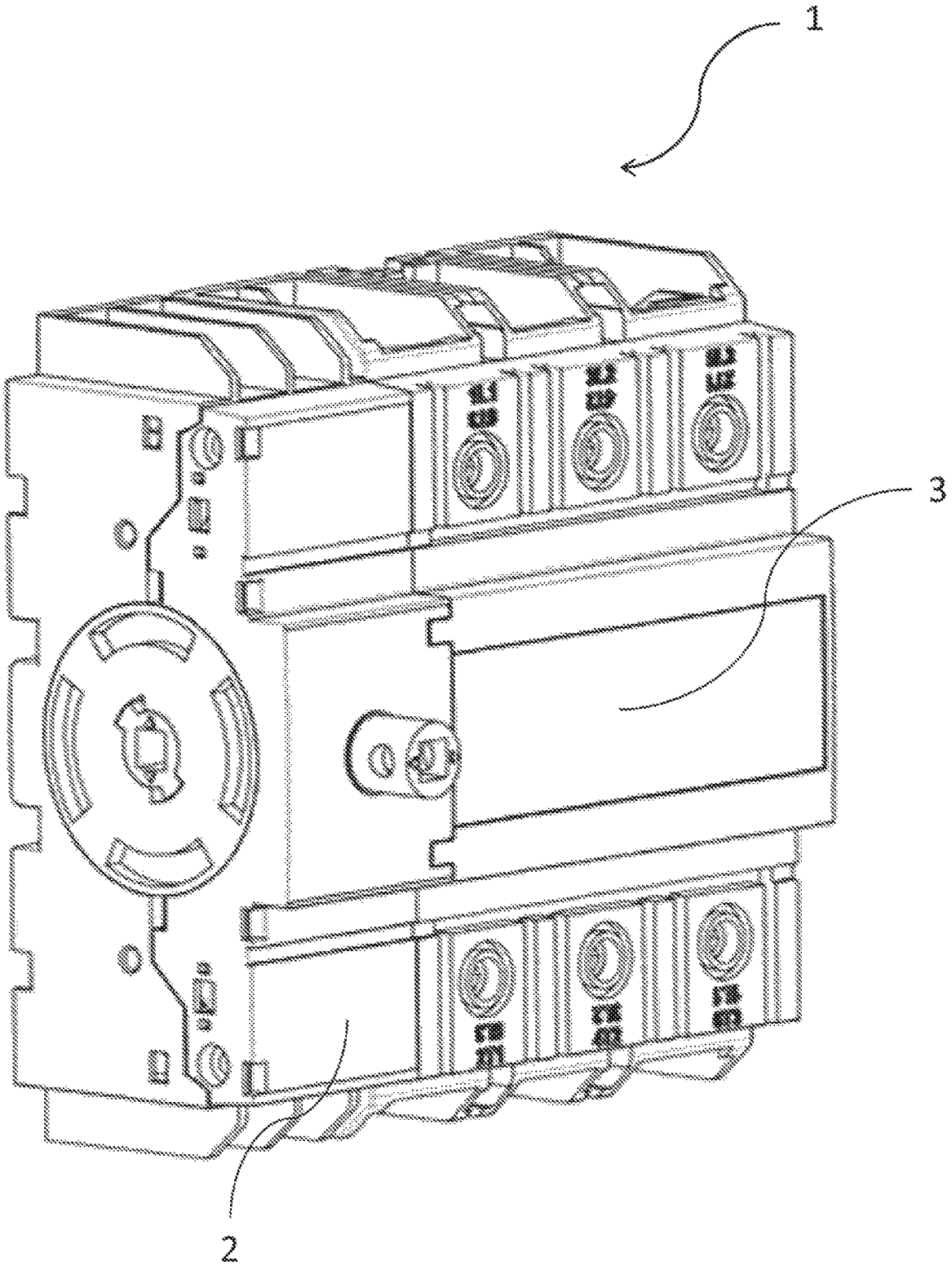

FIG. 1 shows an embodiment of an electric switch (1), comprising a mechanism module (2) and a three-pole contact module (3), connected together. Contact module may comprise different number of poles. The control mechanism (2) may allow controlling the switch from front of the switch, or otherwise from the side end of the switch, just by changing the position of the operating device, like a handle (not shown), correspondingly. No external gear devices are needed.

Figure 2:
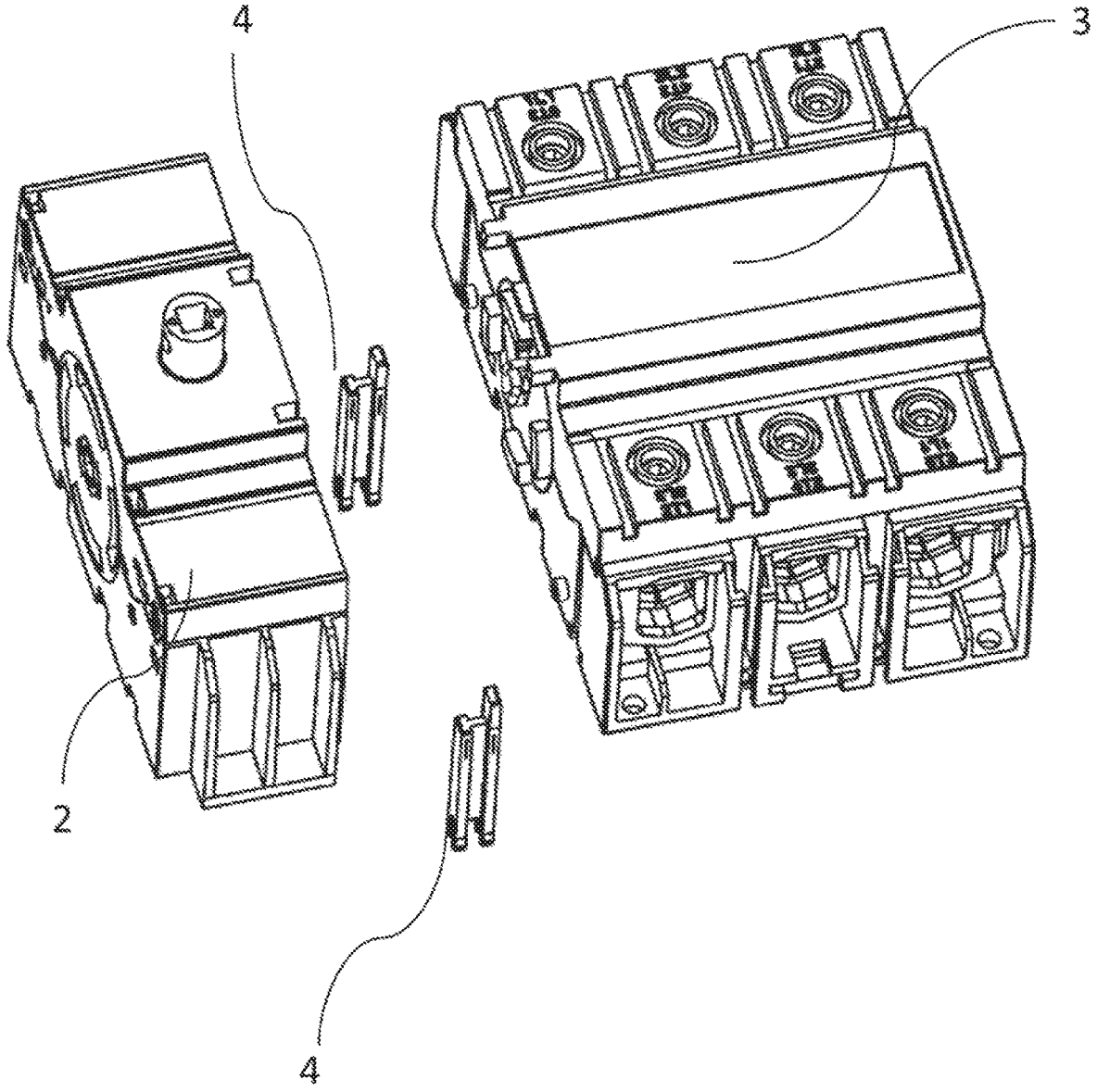
FIG. 2 shows an embodiment of a switch, a mechanism module and a contact module separately, and fixing edges.

FIG. 2 shows the mechanism module (2) and the contact module (3) separately. The modules may be easily and fast fixed to each other by plastic edges (4). Avoiding the use of any screws for fixing, it is easy to couple a suitable contact module depending the need for number of poles.

Figure 3:
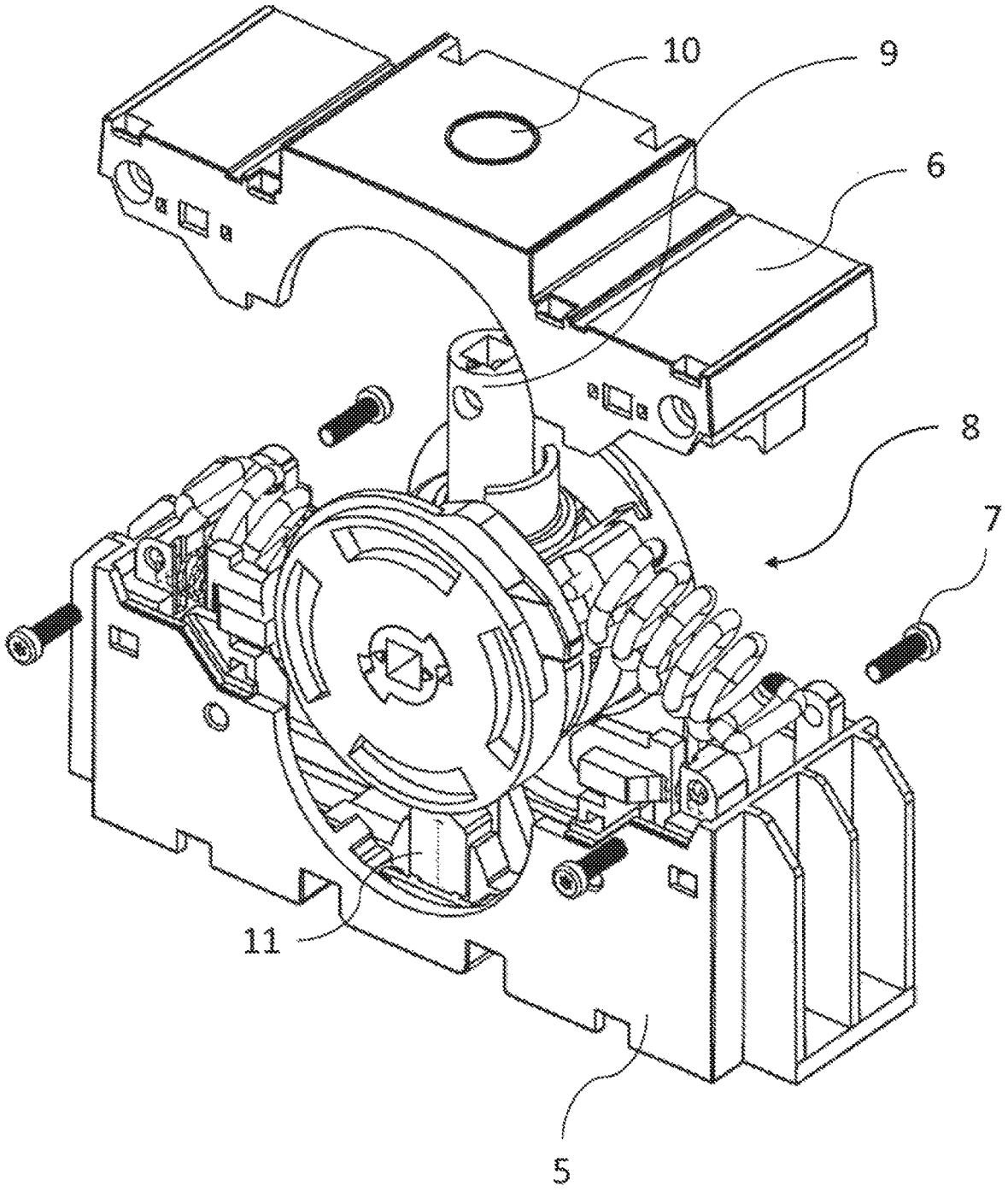
FIG. 3 shows an embodiment of a mechanism module, cover opened.

FIG. 3 shows the mechanism module (2) opened. The base element (5) and the cover element (6) may be fixed by fixing elements (7), preferably by screws.

The mechanism module (2) comprises a set of main operating elements (8). One of the main operating elements, a front pipeshaft (9) is received and supported by an aperture (10) of the cover element (6). A rhytm piece (11) may be fixed movable, preferably slideably on the base module (5).

Figure 4:
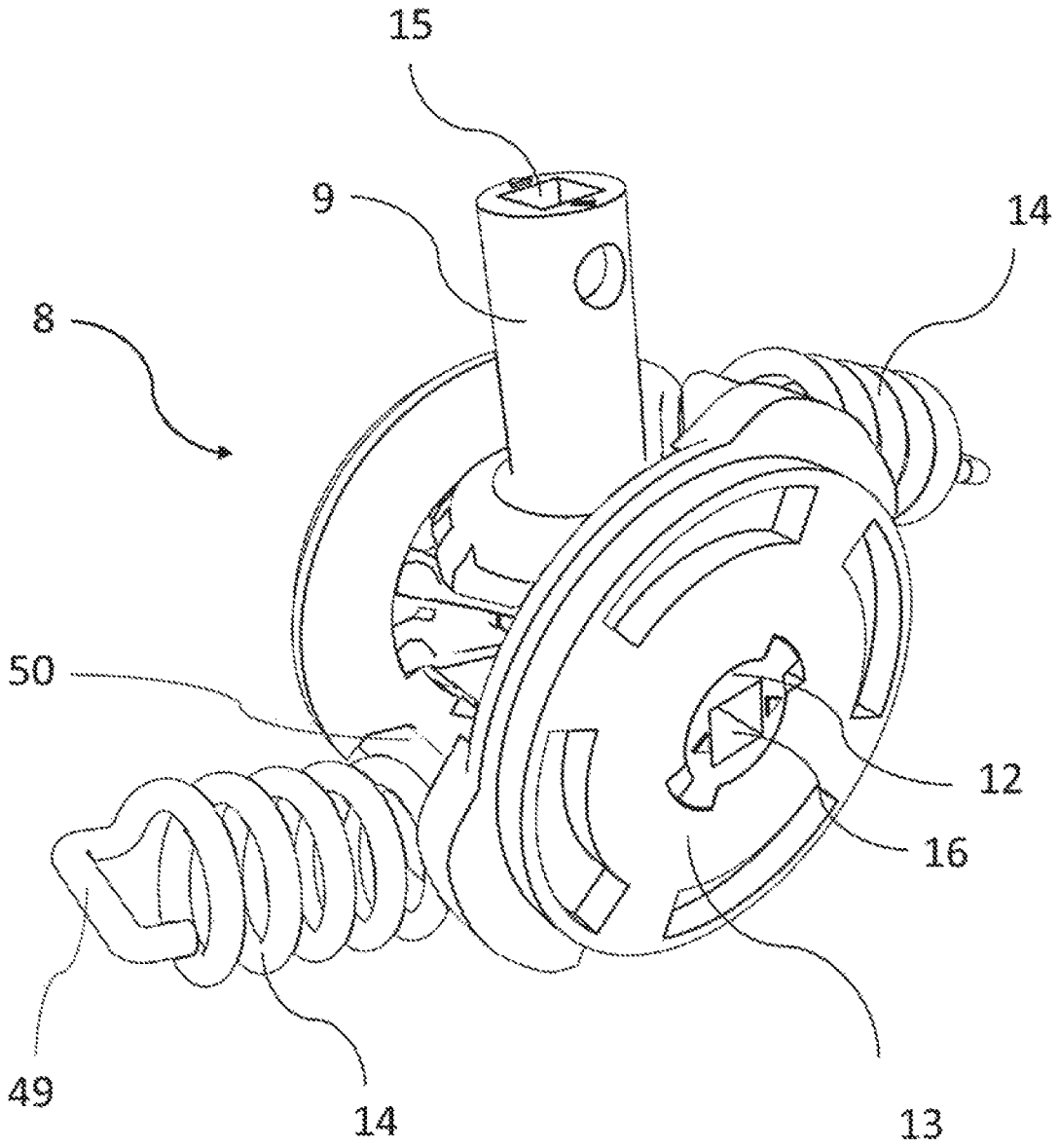
FIG. 4 shows an assembly of main operating elements of the mechanism module.

FIG. 4 shows the set of main operating elements (8), arranged with respect to each other like the elements are on a function mode.

A front pipeshaft (9) may have along its rotational axis preferably a square shaped aperture (15) for receiving a shaft of a handle (not shown) for operating the switch from the front side. An inner pipeshaft (12) may have along its rotational axis preferably a square shaped aperture (16) for receiving a shaft of a handle (not shown) for directly operating the switch (1) from the end side.

A lever (13) receives the inner pipeshaft (12) to be rotationally turned by the inner pipeshaft (12) for compressing main springs (14) to give energy for closing or opening operation of the switch (1). The first end (49) of the main spring (14) is connected to the base element (5) and the second end (50) being connected to the lever (13).

Figure 5:
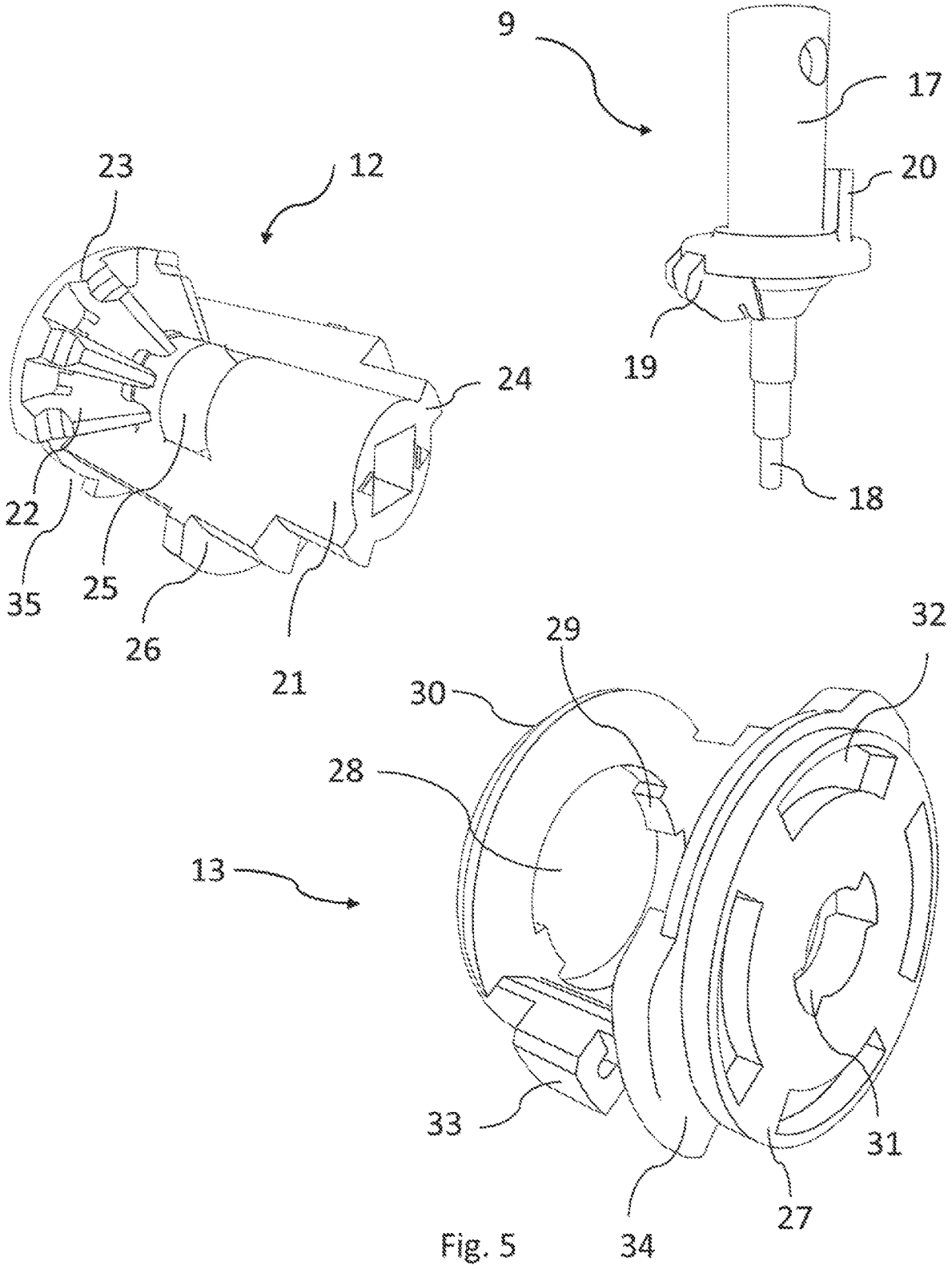
FIG. 5 shows embodiments of main operating elements.

FIG. 5 shows the front pipeshaft (9), the inner pipeshaft (12) and the lever (13) more detailed. The upper portion (17) of the front pipeshaft (9) is tubular shaped to be received and supported by the aperture (10) of the cover element (6) of the mechanism module (2). The lower end (18) of the front pipeshaft (9) is supported by the base element (5). The front pipeshaft (9) has teeth (19) for constituting a gear to transfer a vertical mechanical rotating power created by a handle as a horizontal mechanical rotating power to the contact module. The front pipeshaft (9) comprises means, like an arm (20) for co-operating with means, like a slot on the cover element (6) for limiting the rotating angle of the front pipeshaft (9) up to 90 degrees, corresponding the "0" and "I" positions of the switch (1).

An inner pipeshaft (12) has first end (21) and second end (23), and may have preferably a square shaped aperture (16) on the first end (21) along the axis of rotation for receiving a shaft of a handle (not shown) for directly operating the switch from the end side. The inner pipeshaft (12) comprises teeth (22) at the second end (23) for cooperating with the teeth (19) of the front pipeshaft (9), constituting a gear for transferring a vertical mechanical rotating power from the front pipeshaft (9) to the inner pipeshaft (12). The inner pipeshaft (12) is received and the second end (23) is supported by an aperture (28) of the lever (13). The inner pipeshaft (12) comprises sector shaped legs (24) on the first end (21) for cooperation with slots (31) of the lever (13) and the inner pipeshaft (12) comprises sector shaped slots (35) on the second end (23) for cooperation with legs (29) on the lever. The legs (24,29) and slots (31,35) connect the rotational moment between the inner pipeshaft (12) and the lever (13), but still having an operational clearance by having different circle length for slots and legs. The inner pipeshaft (12) comprises a leg (26) for cooperating with a rhytm piece (11) for ensuring a stable positioning of the handle at "0" or "I" positions.

A rhytm piece (11) is preferably a rectangular shaped piece of plastic with a nose for cooperating with the leg (26) of the inner pipeshaft (12). The rhytm piece (11) may be arranged to move linearly in a slot of the base element (5), being pressed by a spring, the nose against the surface of the inner shaft (12) for ensuring a stable positioning of the handle on the "0" or "I" positions.

The lever (13) comprises a round shaped first end (27) and second end (30) received and rotatable supported by apertures formed on both side walls of the mechanism module (2). The lever (13) comprises at least one bracket (33) for receiving second end (50) of the main spring (14). For better effectivity and less friction, the lever (13) may have a second spring bracket (33) for receiving the second end (50) of a second main spring (14). The first end (27) of the lever comprises sector shaped slots (31) for cooperation with legs (24) and the second end (30) comprises sector shaped legs (29) for transferring the rotational moment between the inner pipeshaft (12) and the lever (13). End (27, 30) of the lever (13) comprises slots (32) for cooperation with contact module to transfer the rotational moment from the mechanism module (2) to the contact module (3).

The main components (8) may preferably be manufactured of plastic, except the main springs (14).

Figure 6:
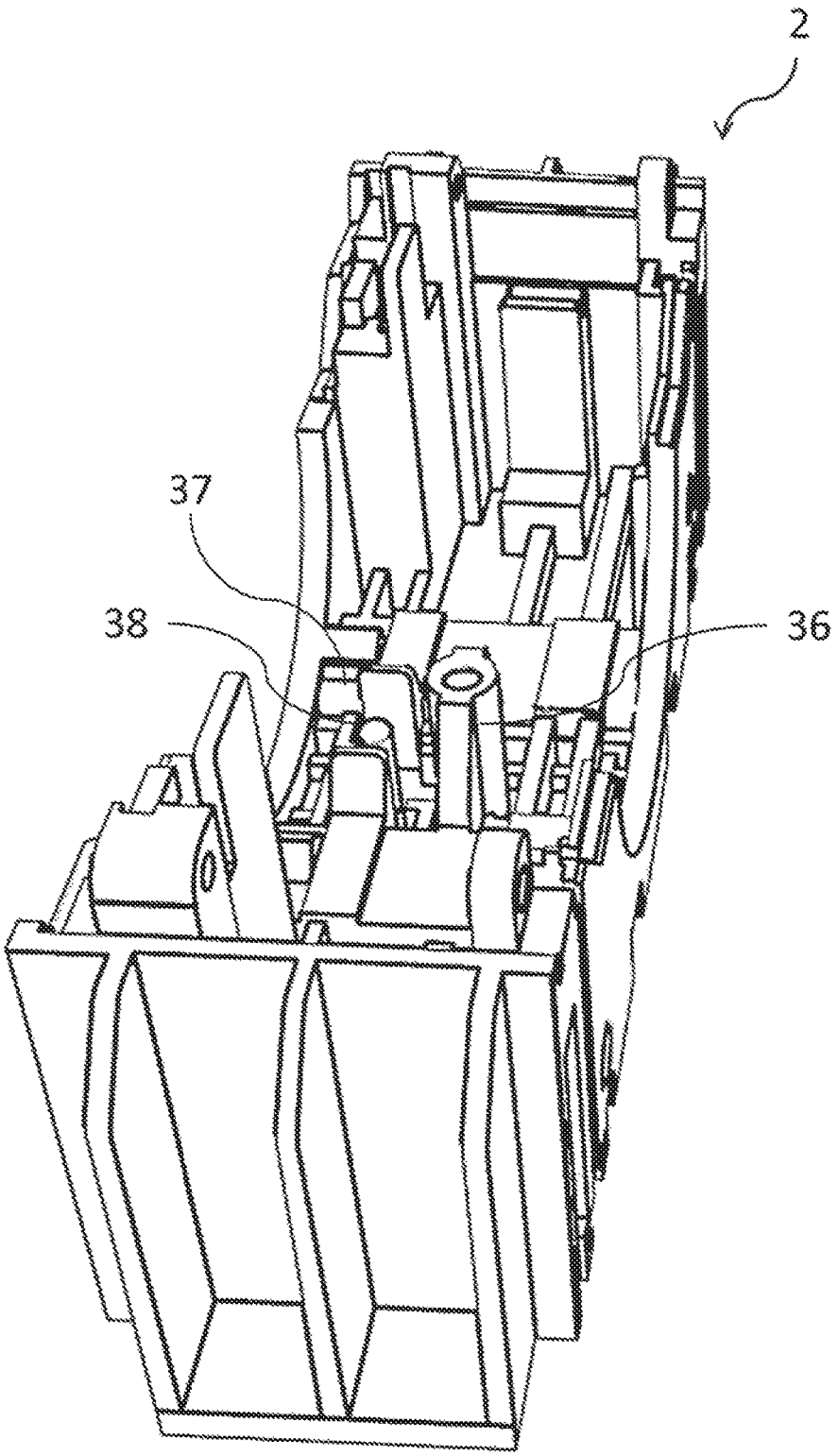
FIG. 6 shows an embodiment of a base element of the mechanism module.

FIG. 6 shows a base element (5) of the mechanism module (2). The base element (5) may comprise grooves on the back for rail mounting. The base element (5) comprises side walls with half circle shaped apertures for constituting a whole circle shaped apertures with the cover element (6) for receiving the round shaped ends (27, 30) of the lever (13). The base element (5) comprises a hollow pin (36) for receiving and supporting the second end (18) of the front pipeshaft (9). The base element may comprise a slot (37) for receiving a rhytm piece (11) and a spring (38) for pressing the rhytm piece (11) toward the surface of the inner pipeshaft (12) for ensuring a stable positioning of the handle at "0" or "I" positions.

Figure 7:
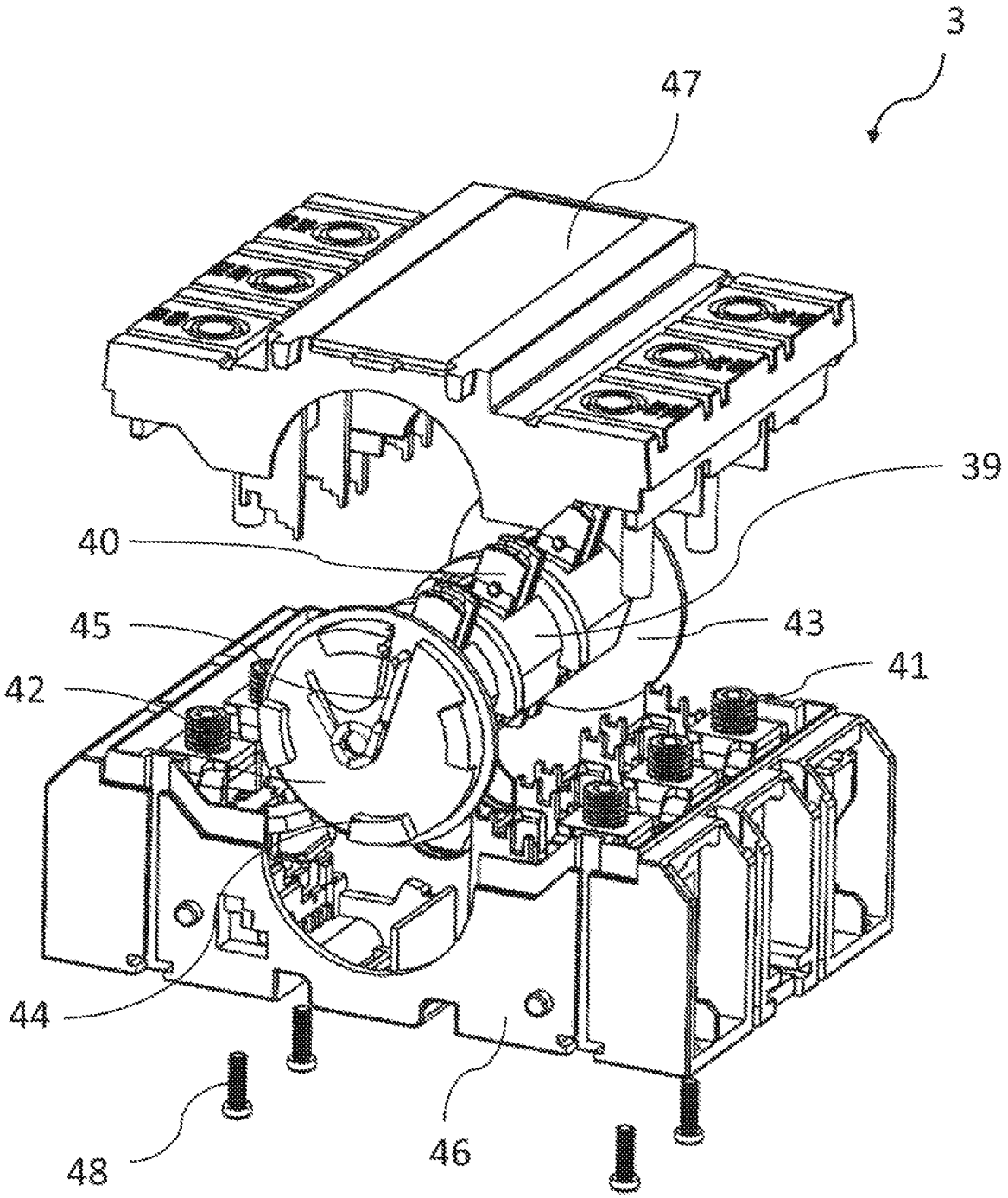
FIG. 7 shows an embodiment of a contact module, opened.

FIG. 7 shows the contact module (3) opened to show a roll (39) with moving rotary contacts (40) and fixed contacts (41). The roll (39) comprises round shaped first end (42) and second end (43) received and supported by apertures of the side walls of the contact module (3). The first end of the roll (42) comprises sector shaped brackets (44) for received and cooperating with the slots (32) of the lever (13). The circle length of the bracket (44) is shorter than the circle length of the slot (32), making a clearance for the rotational movement between the lever (13) and the roll (39). A base element (46) may be fixed with a cover element (47) by fixing means, like screws (48).

Figure 8:
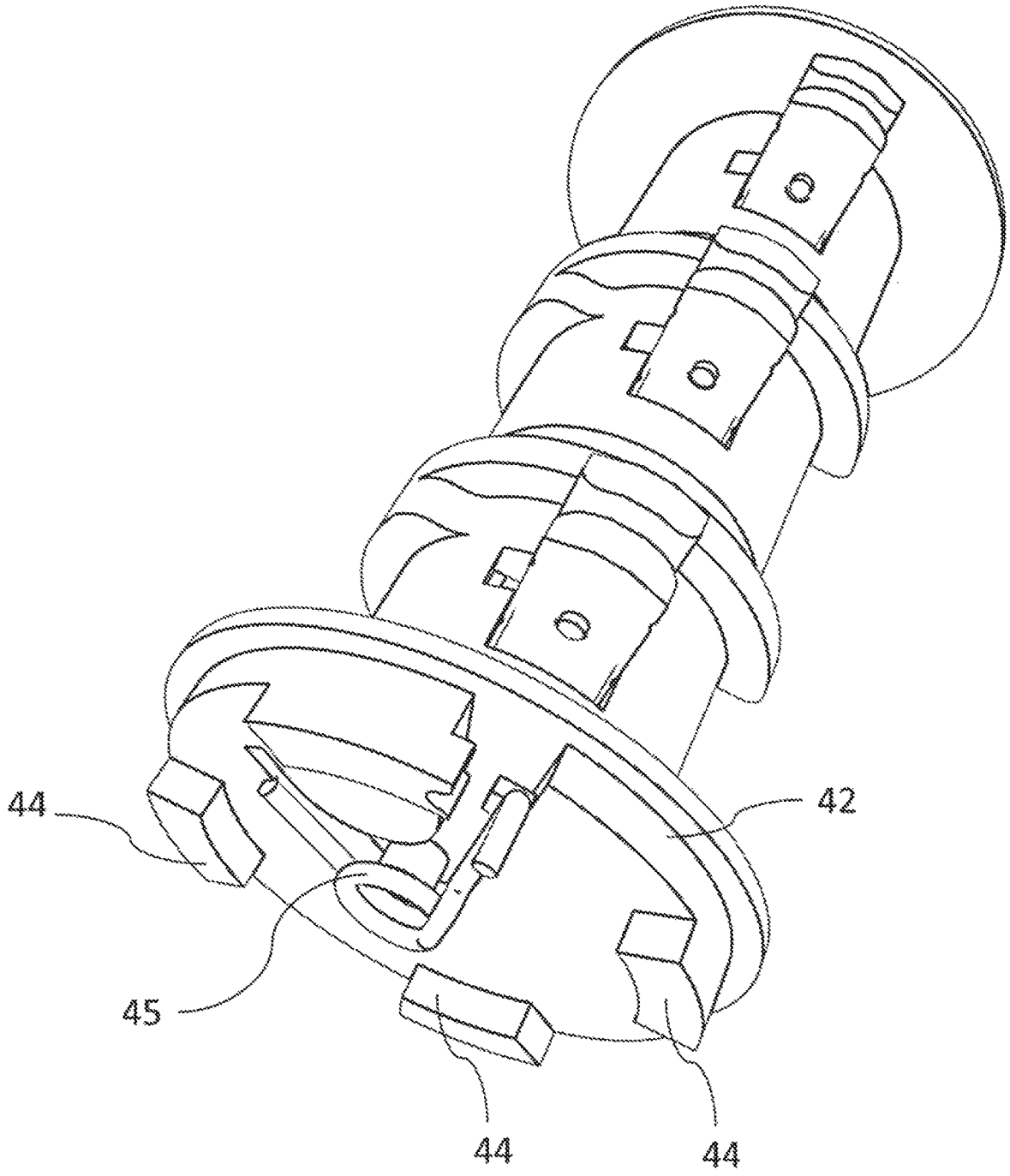
FIG. 8 shows an embodiment of a roll.

FIG. 8 shows a more detailed the roll (39). The first end (42) of the roll (39) comprises the sector shaped brackets (44) and a spring (45).

Functional description of the switch during an operation from open "0" position to closed "I" position.

Full operating angle of the handle connected to the front pipeshaft (9) or to the inner pipeshaft (12) is 90 degree from "0" to "I" position.

The inner pipeshaft (9) has 20 degree cap to lever (13). The lever (13) has 70 degree operation angle.

While the inner pipeshaft (12) has been rotated 55 degrees, the lever (13) has turned 35 degrees and the main springs (14) are compressed reaching a dead center angle and the main springs (14) force is on their maximum level. Turned a little bit over the dead center angle, the main springs (14) will rotate the lever (13) for 35 degrees more to reach the "I" position. Lever (13) will start moving the roll (3) after the inner pipeshaft (12) have been operated 30 degrees. The lever (13) will force the roll to rotate 60 degrees and close the moving contacts (40) at the same time against to the fixed contacts (41). Over rotating has been limited with stoppers for the following components, the front pipeshaft (9), lever (13) and the roll (39).

Functional description of the switch during an operation from closed "I" position to open "0" position.

While the inner pipeshaft (12) has been rotated 55 degrees to direction of "0" position, the lever (13) has rotated 35 degrees and reached dead center angle and also the main springs (14) force is on their maximum level. Turned a little bit more, over the dead center angle the main springs (14) will rotate the lever (13) 35 degrees more to reach the "0" position. The lever (13) will start to move the roll (39) after the inner pipeshaft (12) has been rotated 40 degrees; at the same time the roll (39) will start to open knife contacts slowly 15 degrees until the lever (13) reach the dead center angle and force contacts opened quickly. Until reached dead center angle, the moving contacts (40) are still be electrically connected to the fixed contacts (41). Between the lever (13) and the roll (39), the spring (45) will allow lever turn from 5 to 15, preferably 10 degrees more than in "0" to "I" operation before starting to rotate the roll (39). This spring will also hold the roll (39) on full "0" position by removing the 10 degrees cap between the lever (13) and the roll (39). Over rotating has been limited with stoppers in all following components, the front pipeshaft (9), the lever (13) and the roll (39).

What is claimed is:

1. An electric switch comprising a mechanism module and a contact module, the contact module comprising a base element, a cover element, fixed contacts and a rotary roll for receiving moving contacts, the mechanism module comprising a base element, a cover element, a front pipeshaft for controlling the electric switch from front, an inner pipeshaft for controlling the electric switch from a side end, the pipeshafts being engaged to each other by teeth to form a gear for transferring a moment from the front pipeshaft to the inner pipeshaft, a lever for transferring a moment to the rotary roll, the lever arranged to receive the inner pipeshaft, the inner pipeshaft and the lever being rotatably engaged with each other, and at least one main spring for giving a rotational moment for the lever and being connected at a first end to the base element of the mechanism module, wherein a second end of the main spring is connected to the lever.

2. The electric switch according to claim 1, wherein a piece is arranged to press toward the inner pipeshaft by a spring for ensuring a stable position "0" or "I" for a handle connected to the inner pipeshaft or to the front pipeshaft.

3. The electric switch according to claim 2, wherein the lever comprises slots, the rotary roll has a first end and a second end, the first end comprising brackets for cooperating with the slots for transferring a moment from the lever to the rotary roll.

4. The electric switch according to claim 3, wherein a first end of the rotary roll comprises a spring to allow the lever to turn from 5 to 15 degrees before the rotary roll starts rotating to speed up releasing the moving contacts from the fixed contacts when controlling the electric switch from "I" to "0" position, the moving contacts being knife-type contacts.

5. The electric switch according to claim 4, wherein the first end of the rotary roll comprises the spring to allow the lever to turn 10 degrees.

6. The electric switch according to claim 1, wherein the lever comprises slots, the rotary roll has a first end and a second end, the first end comprising brackets for cooperating with the slots for transferring a moment from the lever to the rotary roll.

7. The electric switch according to claim 6, wherein a first end of the rotary roll comprises a spring to allow the lever to turn from 5 to 15 degrees before the rotary roll starts rotating to speed up releasing the moving contacts from the fixed contacts when controlling the electric switch from "I" to "0" position, the moving contacts being knife-type contacts.

8. The electric switch according to claim 7, wherein the first end of the rotary roll comprises the spring to allow the lever to turn 10 degrees.

9. The electric switch according to claim 1, wherein the inner pipeshaft comprises a portion exposed outside of the base element and the cover element of the mechanism module for engagement with a handle for controlling the electric switch from the side end.

10. The electric switch according to claim 1, wherein the inner pipeshaft is disposed within the lever.

11. The electric switch according to claim 1, wherein the second end of the main spring presses against a portion of the lever.

12. The electric switch according to claim 1, wherein a piece is arranged to press toward the inner pipeshaft by a spring for ensuring a stable position "0" or "I" for a handle connected to the inner pipeshaft.

13. The electric switch according to claim 1, wherein a piece is arranged to press toward the inner pipeshaft by a spring for ensuring a stable position "0" or "I" for a handle connected to the front pipeshaft.

* * * * *